US005465919A

United States Patent [19]

Kikuchi

[11] Patent Number: 5,465,919

[45] Date of Patent: Nov. 14, 1995

[54] STRIP WINDING MECHANISM

[75] Inventor: Koji Kikuchi, Iwate, Japan

[73] Assignee: Kabushiki Kaisha Sato, Japan

[21] Appl. No.: 325,030

[22] Filed: Oct. 18, 1994

[30] Foreign Application Priority Data

Oct. 18, 1993 [JP] Japan ..... 5-061047 U

[51] Int. Cl.[6] ..... B65H 18/10; B65H 75/28

[52] U.S. Cl. ..... 242/532.6; 242/607; 242/609.1

[58] Field of Search ..... 242/532, 532.6, 242/608, 609, 613, 607, 608.2, 609.1

[56] References Cited

U.S. PATENT DOCUMENTS

| | | | |
|---|---|---|---|
| 2,696,335 | 12/1954 | Fies | 242/532.6 |
| 3,395,870 | 8/1968 | Klinger | 242/532 |
| 3,604,650 | 9/1971 | Wennerberg | 242/532.5 |
| 4,161,298 | 7/1979 | Davis | 242/532.6 |
| 4,205,805 | 6/1980 | Yokota et al. | 242/532.6 |
| 5,222,680 | 6/1993 | Barcomb et al. | 242/532.6 |

*Primary Examiner*—John P. Darling
*Attorney, Agent, or Firm*—Ostrolenk, Faber, Gerb & Soffen

[57] ABSTRACT

A strip winding mechanism comprises a rotary shaft, a rotary member fixed on the rotary shaft and having at least one projecting pin member extending parallel to the rotary shaft, and a rotary core receiving a roll of strip material, the rotary core being slidably supported on the rotary shaft and engageable with the rotary member to be rotatable integrally therewith.

18 Claims, 8 Drawing Sheets

STRIP WINDING MECHANISM

BACKGROUND OF THE INVENTION

The present invention relates to a strip winding mechanism, more particularly, to a strip winding mechanism for use in a printer or the like for winding a backing strip, ink ribbon or other such strip-like material.

DESCRIPTION OF THE PRIOR ART

As shown in FIG. 7, one winding mechanism conventionally used to wind a backing strip in a printer has a shaft 3 rotatably supported by a bearing member 2 mounted on the printer casing 1. A rotary member, specifically a winding boss 4, is fitted onto the shaft 3 and a rotary core, specifically a winding core 5 having a flange 5A at its lower end, is fitted onto the winding boss 4. The flange 5A has a pin 6 standing upright thereon to run along the outer surface of the winding core 5 in the direction of its axis. The lower end of the shaft 3 is fitted with a pulley 7 which is rotated by a motor (not shown) via an endless belt 8. When a backing strip 9 is to be wound on the winding core 5, the winding core 5 is fit on the winding boss 4, the leading end 9A of the backing strip 9 is attached to the winding core 5 by inserting it between the pin 6 and the outer surface of the winding core 5, and the winding boss 4 is rotated to wind the backing strip 9 on the winding core 5. Since the leading end 9A of the backing strip 9 is firmly fastened to the winding core 5, the backing strip 9 can be wound with high reliability.

FIG. 8 shows another prior art winding mechanism in which a winding core 13 is formed on opposite sides of its outer surface with grooves 11, 11 running parallel to the axis of the winding core 13. When a backing strip 9 is to be wound on the winding core 13, the leading end 9A of the backing strip 9 is wrapped about half way around the winding core 13 and a U-shaped pin 12 is inserted into the grooves 11, 11 over the backing strip 9 to fasten the backing strip 9 to the winding core 13. The winding core 13 is then rotated to wind the backing strip 9. Since the leading end 9A of the backing strip 9 is securely fastened to the winding core 13, the backing strip 9 can be wound with high reliability.

In the case of the first-mentioned prior art winding mechanism, however, the roll of wound up backing strip 9 tends to become difficult or even impossible to remove from the winding core 5 when the roll is wound to a large diameter. This is because the large roll of tightly wound backing strip 9 strongly presses the pin 6 onto the winding core 5, making it difficult to extract the leading end 9A of the backing strip 9 from where it is caught between the pin 6 and the winding core 5. In such a case, it becomes necessary first to remove the winding core 5 from the winding boss 4 and then to remove the backing strip 9 from the winding core 5 after relieving the winding tension. Every time a roll of backing strip 9 is wound, therefore, the winding core 5 has to be removed from the winding boss 4 and then remounted thereon after the roll of backing strip 9 has been removed. This is both troublesome and inefficient.

In the case of the second-mentioned prior-art winding mechanism, the roll of tightly wound backing strip 9 spontaneously loosens when the U-shaped pin 12 is pulled out of the winding core 13. Moreover, the U-shaped pin 12, being a thin, pin-like rod, can be easily extracted even from a tightly wound roll. Nevertheless, the mechanism has a drawback in that the U-shaped pin 12 is easily misplaced after extraction.

SUMMARY OF THE INVENTION

An object of the present invention is to overcome the aforesaid problems of the prior art by providing a strip winding mechanism which enables a strip wound on a winding core to be removed therefrom with ease and which does not include any components which are easy to misplace.

For achieving these objects, the invention provides a strip winding mechanism comprising a rotary shaft, a rotary member fixed on the rotary shaft and having at least one projecting pin member extending parallel to the rotary shaft, and a rotary winding core slidably supported on the rotary shaft and engageable with the rotary member to be rotatable integrally therewith, a strip being wound on the winding core by engaging the winding core with the rotary member, inserting a leading end of the strip between the pin member and a surface of the winding core and rotating the rotary member to wind the strip onto the winding core over the pin member, and a roll of strip wound on the winding core in this manner being made removable therefrom by sliding the winding core in a direction to disengage it from the rotary member, thereby extracting the pin member from the roll of strip and relaxing its winding tension.

When a strip is to be wound using the strip winding mechanism according to the invention, the winding core is engaged with the rotary member, the leading end of the strip is fastened to the winding core by inserting it between the surface of the winding core and at least one pin member projecting from the rotary member along the outer surface of the winding core in parallel with the axis of the winding core, and the rotary member is then rotated for winding the strip on the winding core over the pin member. Since the leading end of the strip is firmly fastened to the winding core, the strip is wound on the winding core with high reliability.

When a roll of strip wound on the winding core is to be removed therefrom, the winding core is slid along the rotary shaft to separate it from the rotary member and to simultaneously extract the pin or pins attached to the rotary member from the roll of strip material. Since the extraction of the pin or pins relaxes the winding tension of the roll, the roll can be readily removed from the winding core. Since the pins are secured to the rotary member, they also cannot be misplaced.

The above and other objects, characteristic features and advantages of this invention will become apparent to those skilled in the art from the description of the invention given hereinbelow with reference to the accompanying drawings.

BRIEF DESCRIPTION OF THE DRAWING(S)

DETAILED DESCRIPTION OF EMBODIMENTS OF THE INVENTION

A preferred embodiment of the strip winding mechanism according to this invention will now be explained in detail with reference to the drawings.

Figure 1:
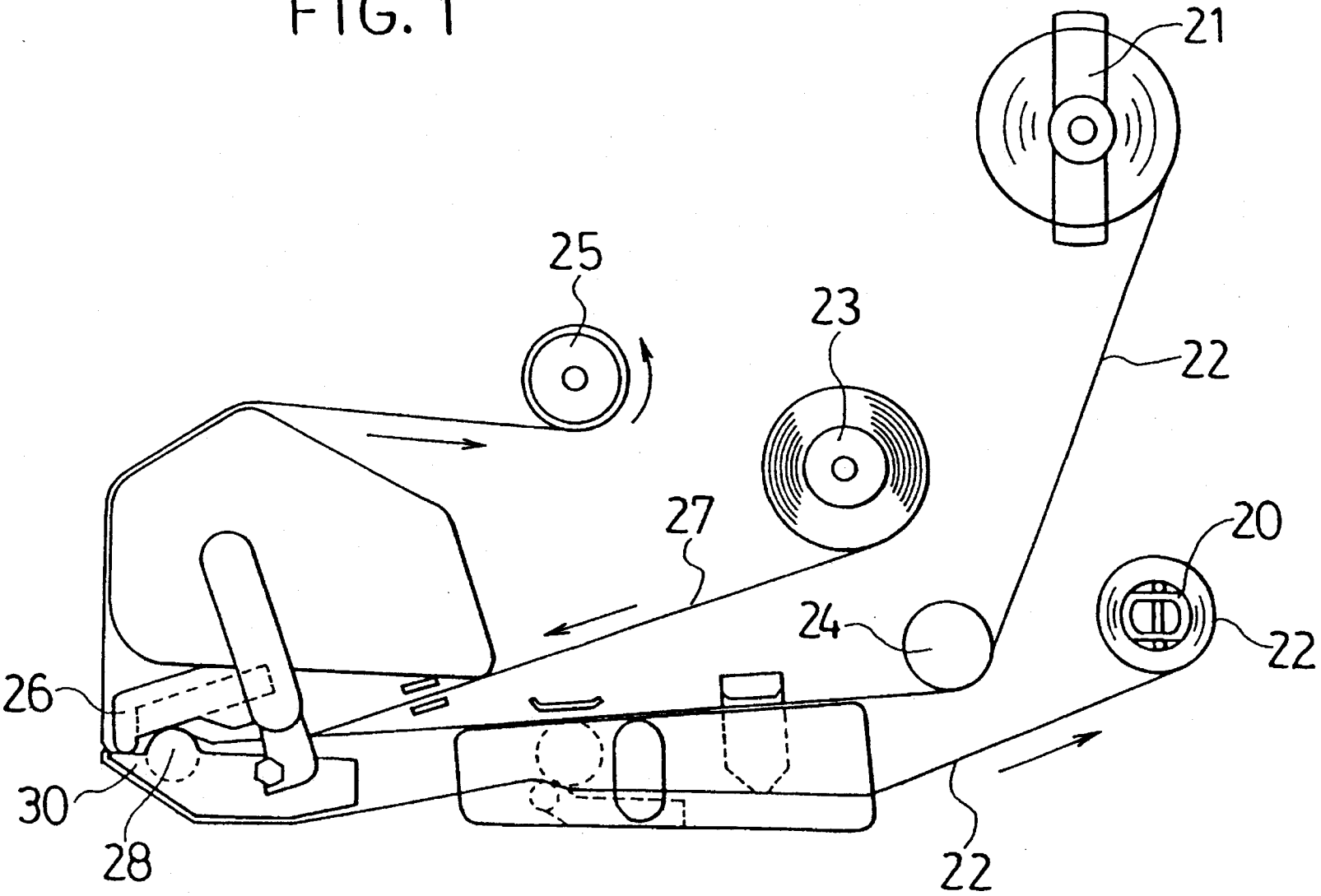
FIG. 1 is a schematic view of a strip winding mechanism according to this invention adapted for use as a backing strip winding mechanism in a printer.

The embodiment will be explained with respect to a strip winding mechanism 20 adapted for use as a backing strip winding mechanism in a printer. As shown in FIG. 1, a roll of backing strip 22 having labels provisionally attached thereto at regular intervals is loaded on a backing strip supply reel 21 and the backing strip 22 is fed to a printer head 26 via a guide roller 24. An ink ribbon 27 from an ink ribbon supply reel 23 is also fed to the printer head 26. As the ink ribbon 27 and the backing strip 22 pass between the printer head 26 and a platen roller 28, the printer head 26 prints the labels with required information, whereafter the backing strip 22 is turned back at a peeler 30 so as to peel the labels off the backing strip 22. The labels peeled off the backing strip 22 are supplied to a label attacher (not shown) and the backing strip 22 is wound by a strip winding mechanism 20 according to this invention. After the roll of backing strip 22 wound by the strip winding mechanism 20 reaches a certain size it is removed from the strip winding mechanism 20 and discarded.

Figure 2:
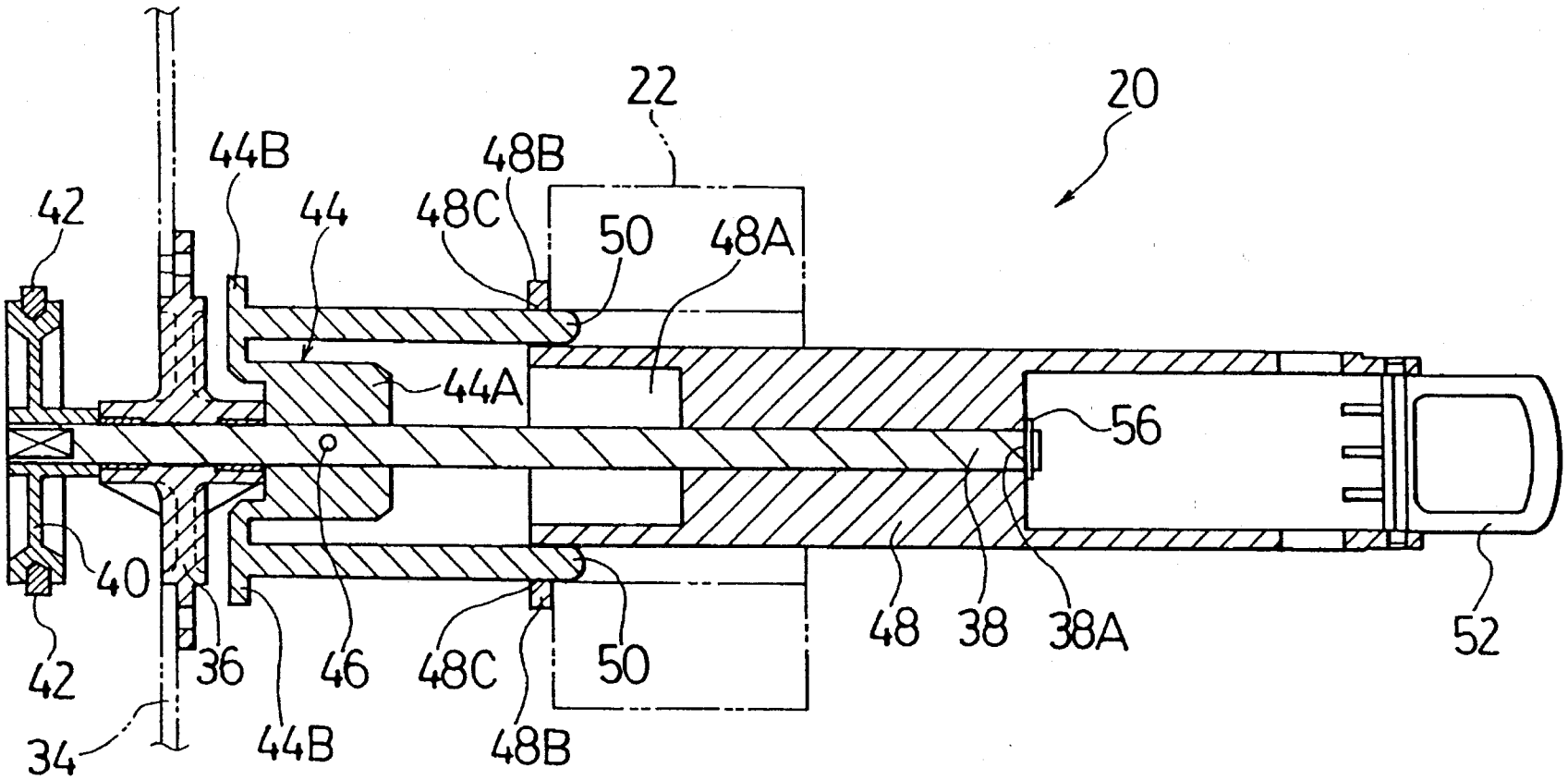
FIG. 2 is a sectional view showing the structure of a strip winding mechanism according to this invention.

The strip winding mechanism 20 will now be explained. As shown in FIG. 2, the strip winding mechanism 20 has a rotary shaft 38 rotatably supported by a bearing member 36 mounted on the printer casing 34. The portion of the shaft 38 inside the casing 34 is fitted with a pulley 40 connected through an endless belt 42 with a motor (not shown) for rotating the shaft 38. On the inside of the casing 34, a rotary member 44 (hereinafter called the winding boss) is fixed on the shaft 38 by a locking pin 46 and a rotary core 48 (hereinafter called the winding core) is fitted over the shaft 38 to be axially slidable thereon. The winding boss 44 is formed as cylindrical projection 44A rising from a flange 44B. The cylindrical projection 44A has flat portions running parallel to its axis on opposite sides, and pins 50, 50 rising from the flange 44B extend along these flat portions at a short distance therefrom. The pins 50, 50 can be formed integrally with the winding boss 44 or can be separate members. The winding core 48 is of generally cylindrical configuration but has flat portions corresponding to those of the cylindrical projection 44A running parallel to its axis on opposite sides. One end of the winding core 48 (the left end in the drawing) is formed with a concavity 48A, configured to fit over the cylindrical projection 44A of the winding boss 44. A flange 48B corresponding to the flange 44B of the winding boss 44 is formed around the proximal end of the concavity 48A. The flange 48B is formed with holes 48C for passage of the pins 50, 50. The other end of the winding core 48 (the right end in the drawing) is formed with a handle 52 for pulling the winding core 48 and thereby sliding it along the rotary shaft 38.

Figure 3:
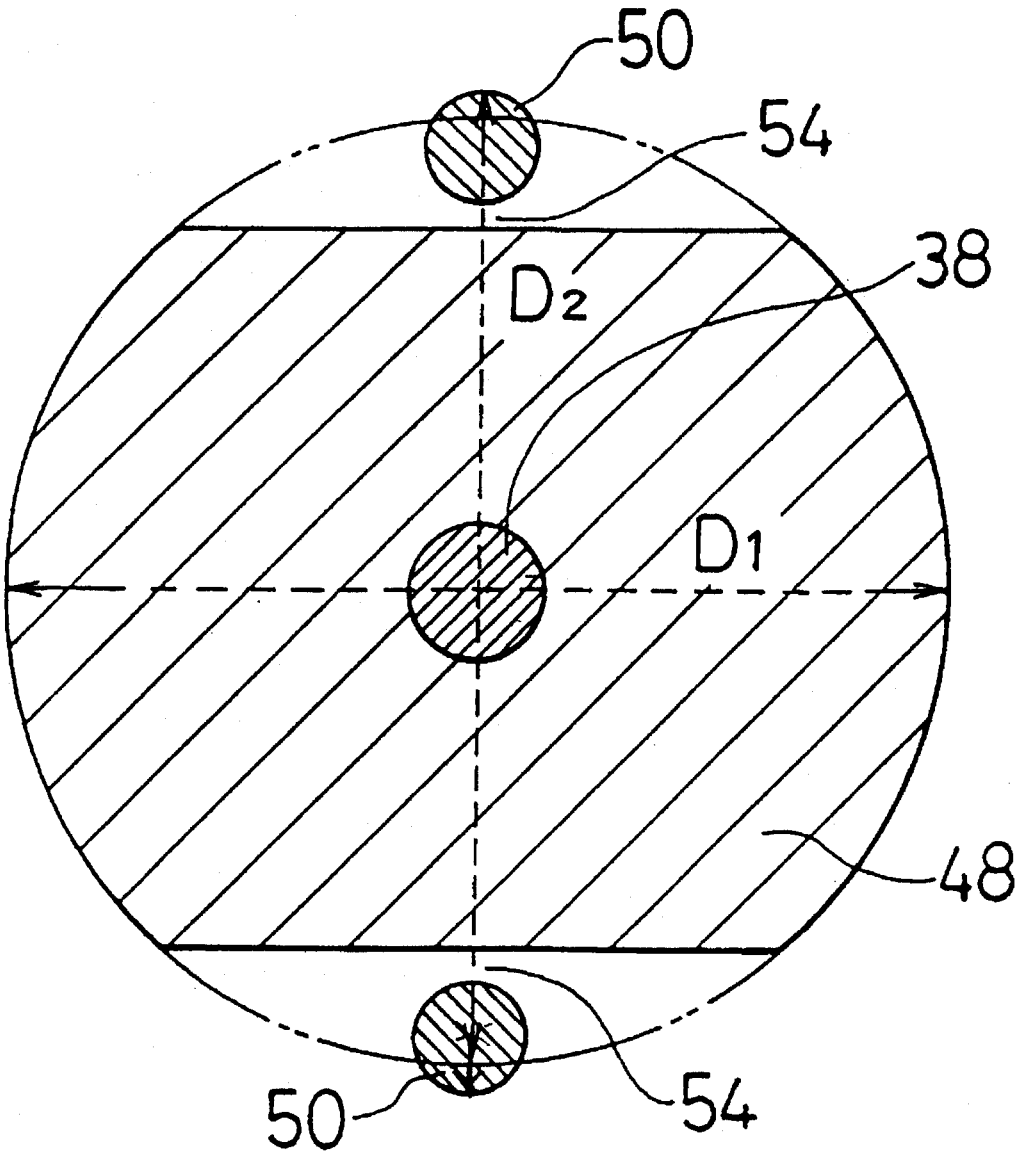
FIG. 3 is sectional view showing the positional relationship between a winding core and pins attached to a winding boss.
Figure 4:
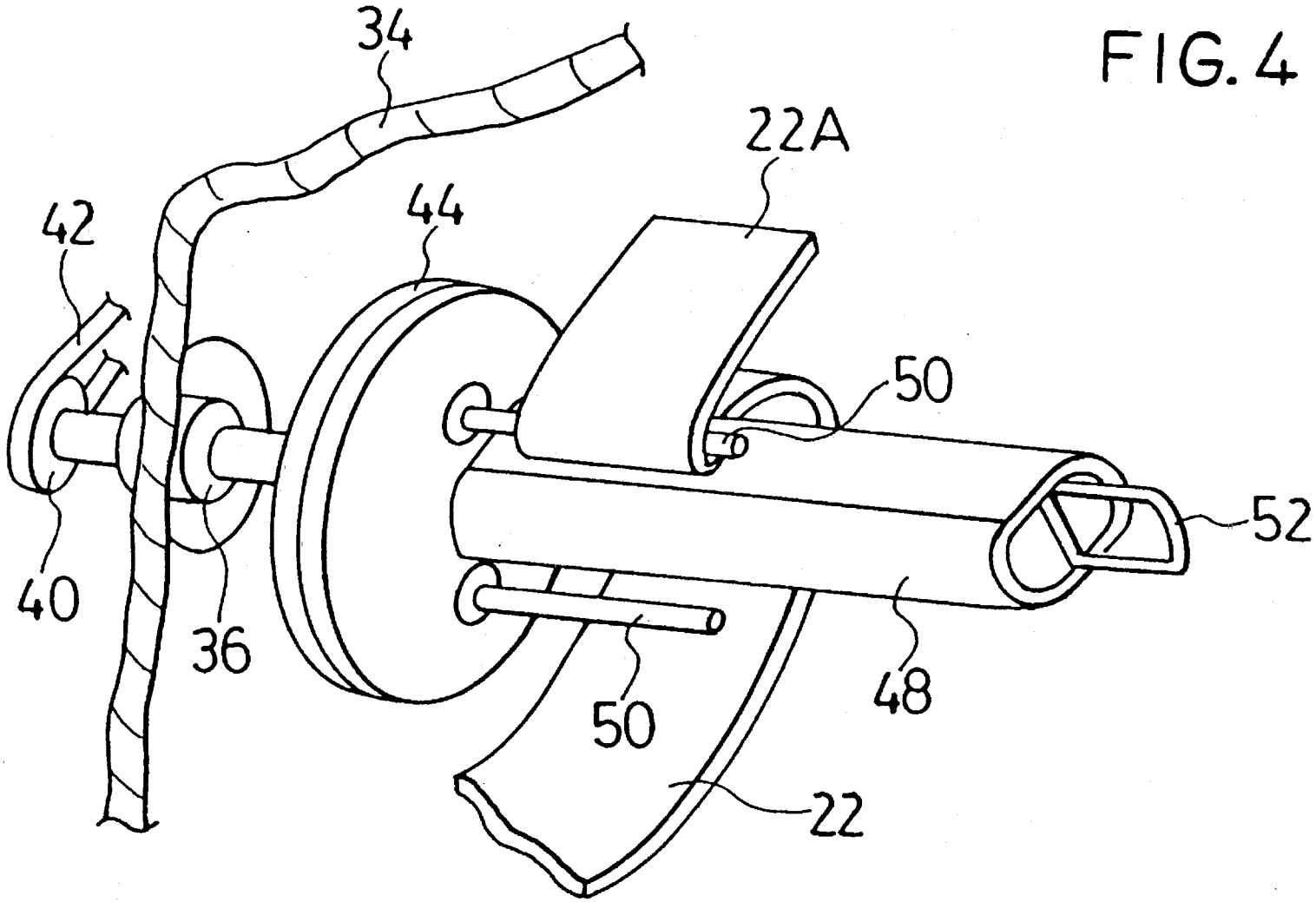
FIG. 4 is a perspective view showing how the leading end of a backing strip is fixed to a strip winding mechanism according to this invention.

In the strip winding mechanism 20 of the aforesaid configuration, when the pins 50, 50 rising from the flange 44B of the winding boss 44 are passed through the holes 48C of the winding core 48 and the winding core 48 is slid along the shaft 38 toward the winding boss 44, the concavity 48A of the winding core 48 fits over the cylindrical projection 44A of the winding boss 44, thus engaging the winding core 48 with the winding boss 44. As a result, the winding core 48 and the winding boss 44 rotate as an integral body. In this engaged state, the pins 50, 50 of the winding boss 44 extend along the opposite flat portions on the outer surface of the winding core 48. As shown in FIG. 3, a gap 54 approximately equal to the thickness of the backing strip 22 is formed between each pin 50 and the associated flat portion of the winding core 48 and the diameter $D_1$ of the winding core 48 at its unflattened portion is slightly smaller than the diameter $D_2$ between the outermost points of the pins 50, 50. As shown in FIG. 4, when the backing strip 22 is to be wound on the winding core 48, the leading end 22A of the backing strip 22 is fixed to the winding core 48 by inserting it into the gap 54. The diameter $D_1$ is made slightly smaller than the diameter $D_2$ for two reasons: (1) so that the leading end 22A of the backing strip 22 will be firmly held in place as the backing strip 22 being wound onto the winding core 48 over the pins 50, 50 presses the pins 50, 50 onto the surface of the winding core 48 with the leading end 22A of the backing strip 22 caught therebetween and (2) so that the pressure on the pins 50, 50 will cause the diameter $D_2$ to become approximately equal to the diameter $D_1$, thus ensuring that the backing strip 22 will be wound into an almost perfectly circular roll.

Figure 5:
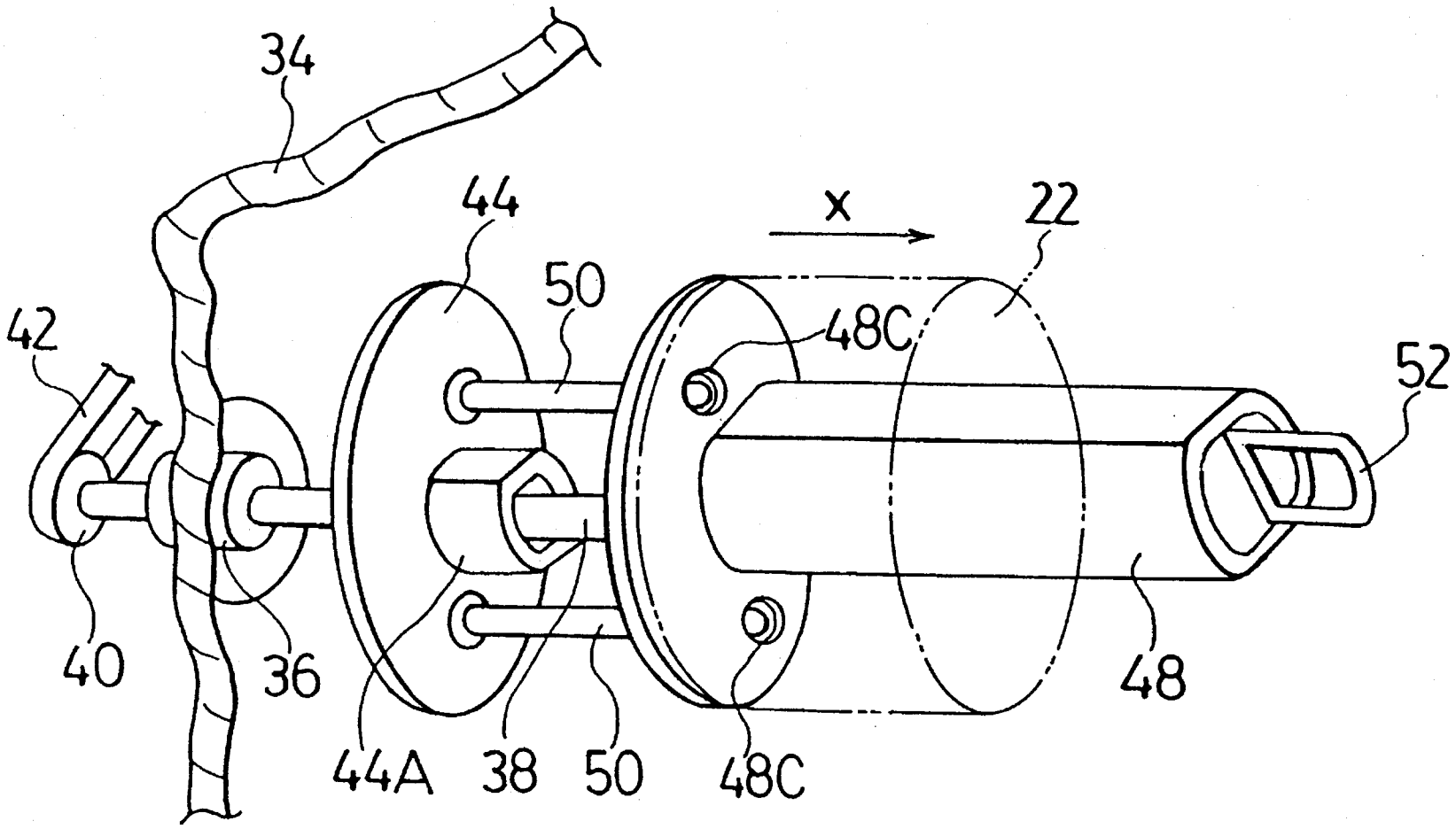
FIG. 5 is a perspective view showing how a strip roll wound on a strip winding mechanism according to this invention is removed.

As shown in FIG. 5, when the winding core 48 is slid along the shaft 38 away from the winding boss 44, the concavity 48A of the winding core 48 disengages from the cylindrical projection 44A of the winding boss 44 and the flat portions of the winding core 48 move apart from the pins 50, 50 of the winding boss 44. Moreover, as shown in FIG. 2, the distal end 38A of the shaft 38 is provided with a stop member 56 so located that when the winding core 48 slides outward and runs into the stop member 56, the winding core 48 is stopped. At that time, the pins 50, 50 of the winding boss 44 are not completely extracted from the holes 48C of the winding core 48 and a portion of the pins 50, 50 remains inserted into the holes 48C. Owing to this arrangement, the winding core 48 is prevented from coming off the shaft 38 and, moreover, since the alignment between the flat surfaces of the cylindrical projection 44A of the winding boss 44 and the concavity 48A of the winding core 48 is maintained, the winding core 48 can be brought back into engagement with the winding boss 44 simply by using the handle 52 to push the winding core 48 in the direction of the winding boss 44.

The operation of the strip winding mechanism 20 configured in the foregoing manner will now be explained.

The leading end 22A of the backing strip 22 wound on the backing strip supply reel 21 is passed between the printer head 26 and the platen roller 28, turned back at the peeler 30 and extended to the strip winding mechanism 20 according to this invention. Then, with the winding boss 44 and the winding core 48 in the engaged state shown in FIG. 4, the leading end 22A of the backing strip 22 is inserted between one pin 50 of the winding boss 44 and the associated flat surface portion of the winding core 48, whereafter the winding boss 44 is rotated one or two revolutions by hand for wrapping the leading end 22A of the backing strip 22 onto the winding core 48 and thus fastening it hereto. Next, the motor is turned on to rotate the shaft 38 and, in turn, integrally rotate the winding boss 44 and the winding core 48, thus causing the backing strip 22 to be wound on the winding core 48. Since the leading end **22*a* of the backing strip 22 is firmly fastened to the winding core 48, the backing strip 22 is wound on the winding core 48** with high reliability.

When the winding of the backing strip 22 on the winding core 48 has been completed and the motor has been turned off to stop the rotation of the strip winding mechanism 20, the winding core 48 is pulled by the handle 52 to slide it along the shaft 38 in the direction of the arrow in FIG. 5 until it strikes against the stop member 56 of the shaft 38. As a result, the winding core 48 comes out of engagement with the winding boss 44 and the pins 50, 50 are extracted from the roll of backing strip 22 that has been wound on the winding core 48. Since the extraction of the pins 50, 50 relaxes the tension of the tightly wound roll of backing strip 22, the roll can be easily taken off the winding core 48. As the pins 50, 50 are attached to the winding boss 44, there is no danger of their being misplaced or lost.

In contrast to the prior art strip winding mechanisms, the strip winding mechanism 20 according to the present invention thus enables the roll of backing strip 22 wound on the winding core 48 to be readily removed from the winding core 48 without removing the winding core 48 from the winding boss 44 or removing the pins 50, 50 from the mechanism. Since there is no need for the troublesome operation of removing the winding core 48 from the winding boss 44 every time a roll of backing strip 22 has been wound, the working efficiency is high. In addition, the pins 50, 50 cannot be misplaced or lost.

Figure 6:
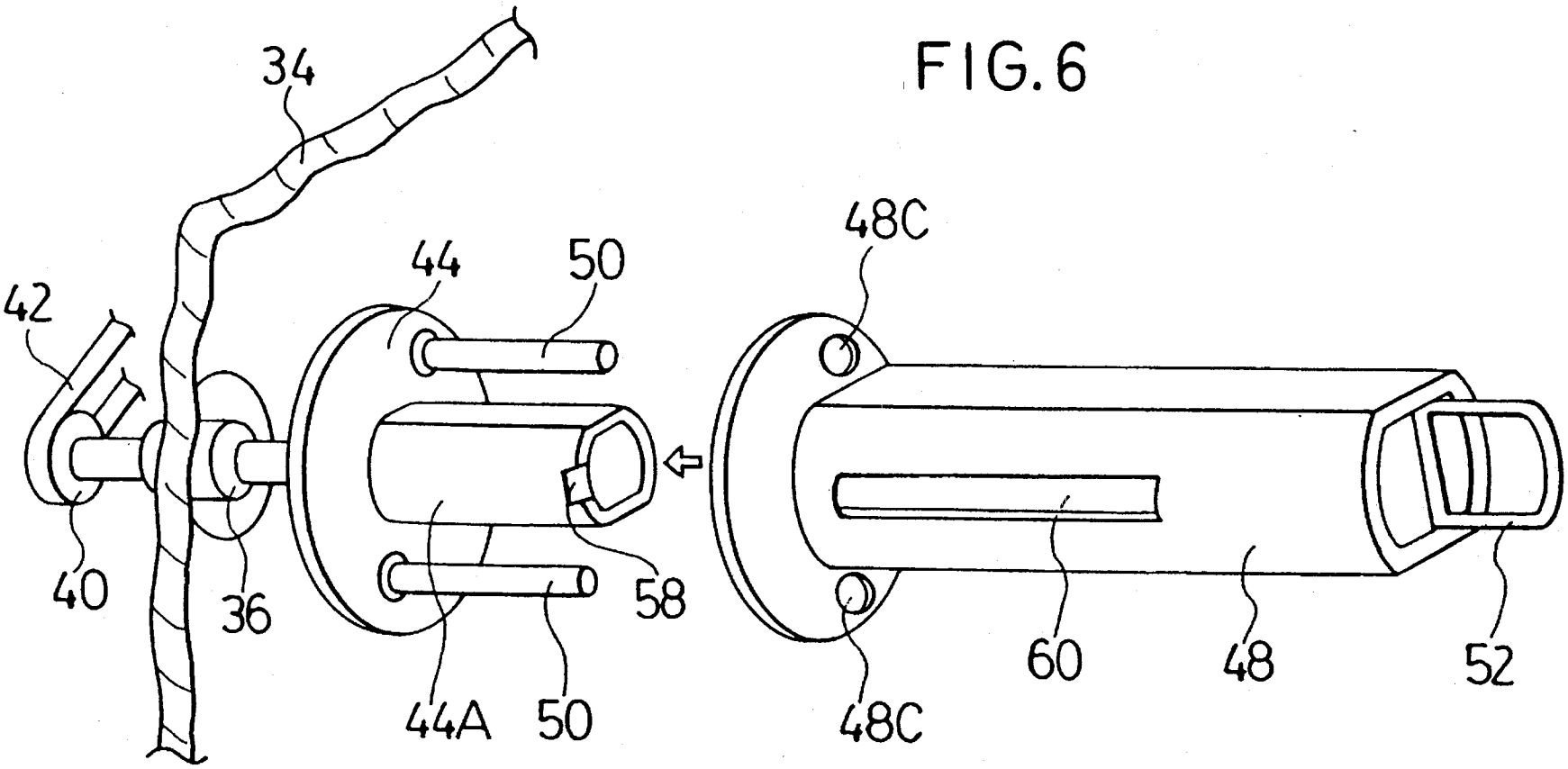
FIG. 6 is a perspective view of a strip winding mechanism according to this invention having a stop member provided on the winding boss thereof.
Figure 7:
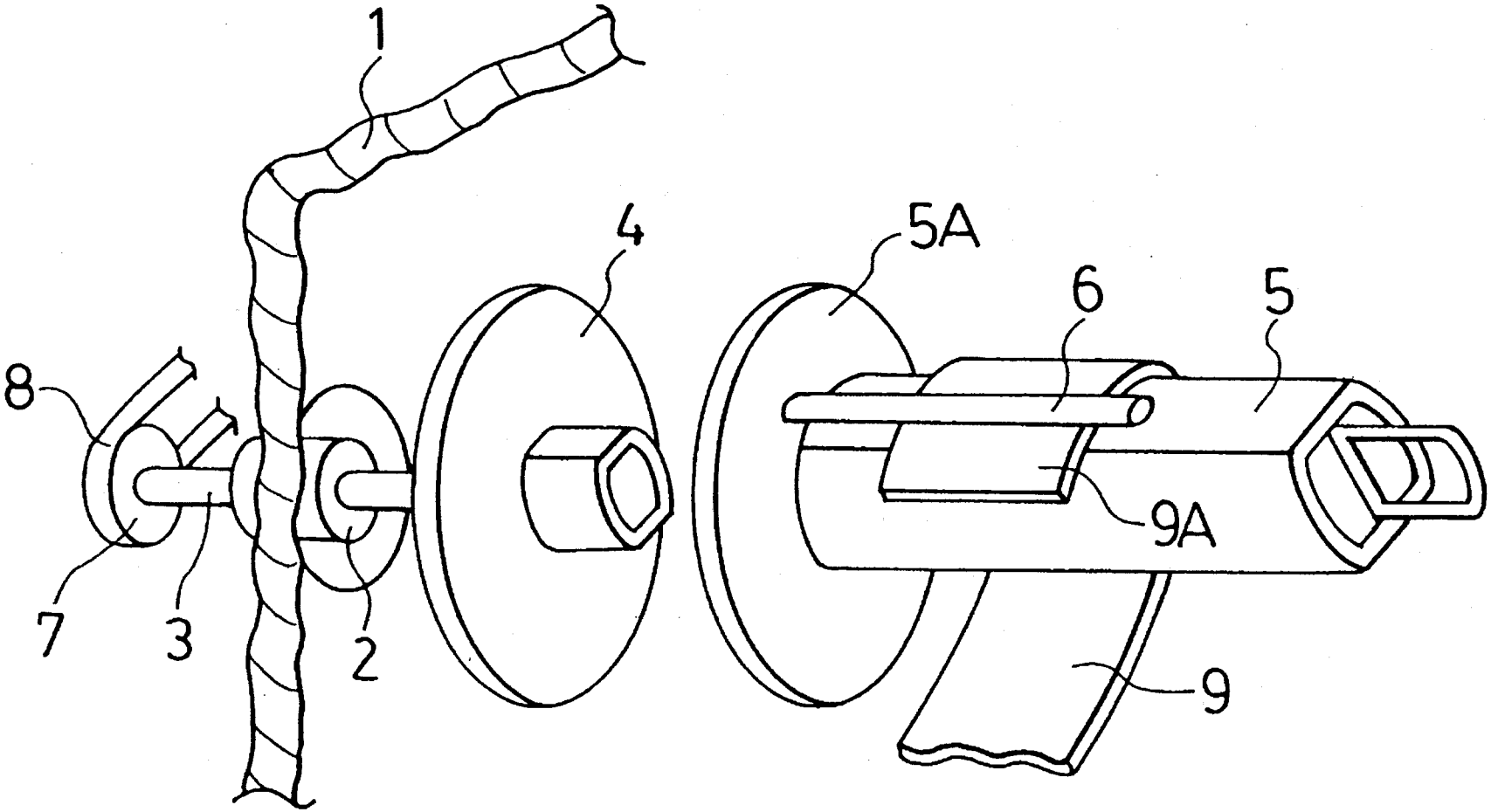
FIG. 7 PRIOR ART
FIG. 7 is a perspective view of a prior art strip winding mechanism.
Figure 8:
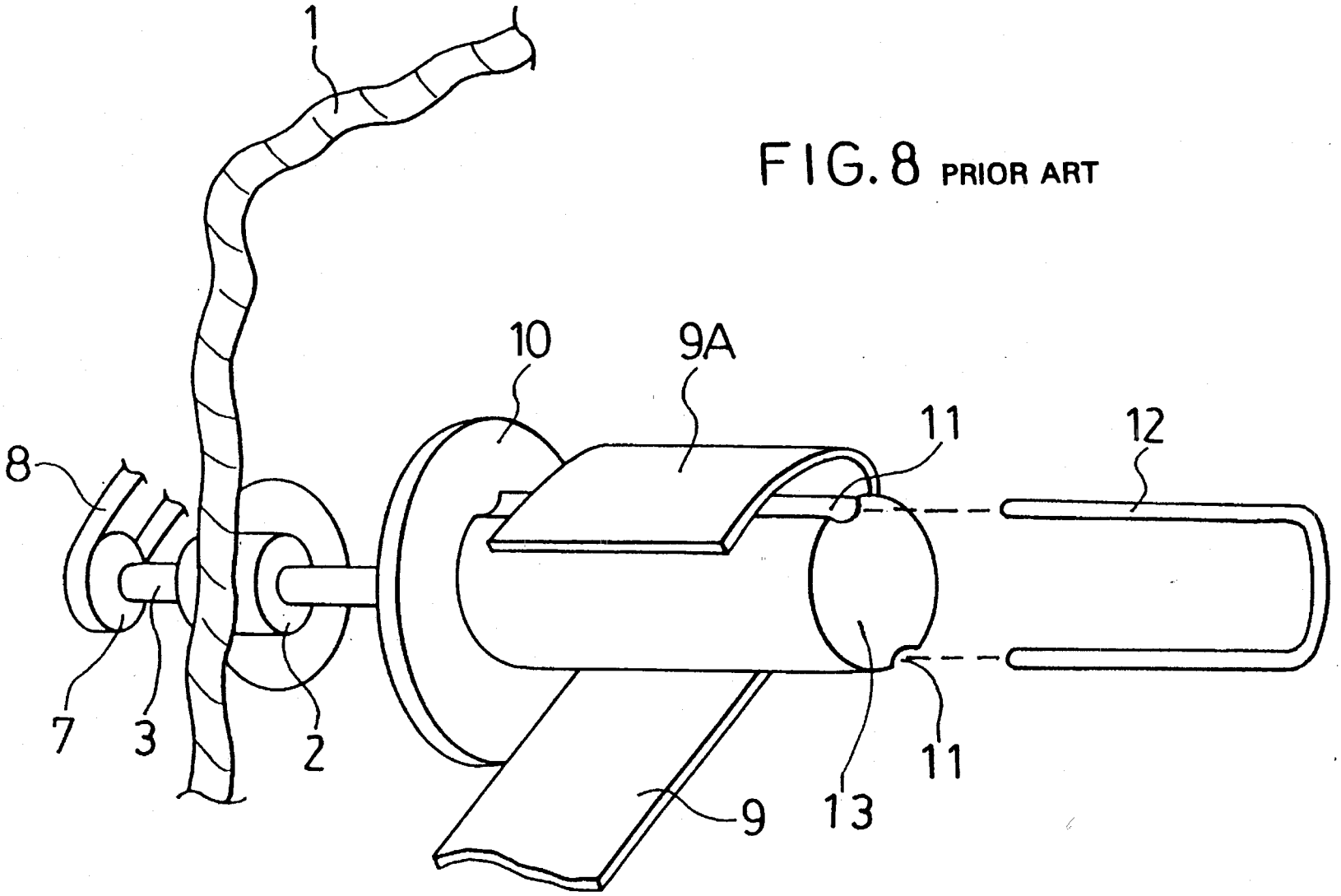
FIG. 8 PRIOR ART
FIG. 8 is a perspective view of another prior art strip winding mechanism.

Although the foregoing embodiment was explained with respect to the case where the stop member 56 is provided on the distal end of the shaft 38, the invention is not limited to this arrangement and it is alternatively possible to provide the stop member on the winding boss 44 as shown in FIG. 6. In this case, the stop member is a claw 58 projecting radially outward from the distal end of the cylindrical projection 44A of the winding boss 44, and an oblong hole 60 for slidably receiving the claw 58 is formed in the wall of the winding core 48 to extend in the axial direction of the winding core 48. For enabling the winding core 48 to be fit over and removed from the winding boss 44, the claw 58 is preferably formed of a material with a degree of resilience such that it bends when subjected to a force of greater than a prescribed value but does not bend when subjected to a force on the order of that required to stop the winding core 48 from sliding. In this case it is also possible to elongate the cylindrical projection 44A of the winding boss 44 and slide the winding core 48 along the cylindrical projection 44A of the winding boss 44.

Although the invention has been described with respect to a strip winding mechanism applied as a backing strip winding mechanism in a printer, the invention is not limited to this application and the invention can also be applied to a winding mechanism for an ink ribbon or to any other device requiring removal of a roll of strip, ribbon or the like from the winding core on which it is wound.

When a strip is to be wound using the strip winding mechanism according to the invention, the winding core is engaged with the rotary member, the leading end of the strip is fastened to the winding core by inserting it between the surface of the winding core and at least one pin member projecting from the rotary member along the outer surface of the winding core in parallel with the axis of the winding core, and the rotary member is then rotated for winding the strip on the winding core. When a roll of strip wound on the winding core is to be removed therefrom, the winding core is slid along the rotary shaft to separate it from the rotary member and simultaneously extract the pin or pins of the rotary member from the roll of strip.

As a result, the strip can be wound on the winding core with high reliability and the wound roll of strip can be readily removed from the winding core.

Thus, in contrast to the prior art strip winding mechanisms, the strip winding mechanism according to the present invention enables the roll of strip wound on the winding core to be readily removed from the winding core without removing the winding core from the rotary member or removing the pin members from the mechanism. Since there is no need for the troublesome operation of removing the winding core from the rotary body every time a roll of strip has been wound, the working efficiency is high. In addition, the pin members cannot be misplaced or lost.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A strip winding mechanism comprising:

a rotary shaft;

a rotary member fixed on the rotary shaft and having at least one projecting pin member extending parallel to the rotary shaft; and a rotary core slidably supported on the rotary shaft and engageable with the rotary member to be rotatable integrally therewith;

the rotary core being adapted to receive a strip to be wound thereon, the strip being wound on the rotary core by engaging the rotary core with the rotary member, inserting a leading end of the strip between the pin member and a surface of the rotary core and rotating the rotary member to wind the strip onto the rotary core over the pin member, a roll of strip wound on the rotary core being made removable therefrom by sliding the rotary core in a direction away from the rotary member to at least partly disengage it from the rotary member, thereby extracting the pin member from the roll of strip and relaxing its winding tension.

2. The strip winding mechanism of claim 1, further comprising a stop mechanism for limiting slidable movement of said rotary core on said rotary shaft.

3. The strip winding mechanism of claim 2, wherein said stop mechanism comprises a spacer at an end of said rotary shaft farthest from said rotary member for engaging a stop surface of said rotary core.

4. The strip winding mechanism of claim 2, wherein the stop mechanism comprises a radially extending tab on said rotary member received in an oblong slot in said rotary core, the oblong slot extending in a direction parallel to an axis of said rotary core, the oblong slot having an end acting as a stop surface for engaging said radially extending tab.

5. The strip winding mechanism of claim 1, further comprising a second projecting pin member extending from said rotary member parallel to said rotary shaft and disposed in a relationship of 180° with respect to said first pin member.

6. The strip winding mechanism of claim 5, wherein a distance from a radially outermost surface of the first pin member to a radially outermost surface of the second opposite pin member is greater than the diameter of said rotary core, said pin members being disposed at a spacing away from flat spots provided on said surface of the radial core.

7. The strip winding mechanism of claim 1, wherein said rotary core has a flange for supporting the wound strip on the rotary core and said pin member is slidably received in a hole of the flange of said rotary core.

8. The strip winding mechanism of claim 7, wherein the rotary core is only partly disengageable from the rotary member, whereby the projecting member remains in said hole in the flange of the rotary core even when said rotary core has been stopped from further slidable movement on the rotary shaft by a stop mechanism.

9. The strip winding mechanism of claim 1, further comprising a handle at an end of said rotary core farthest from said rotary member for allowing grasping of said rotary core to disengage it from the rotary member.

10. A strip winding mechanism comprising:

a rotary shaft;

a rotary member fixed on the rotary shaft and having at least one projecting pin member extending parallel to the rotary shaft; and a rotary core slidably supported on the rotary shaft and engageable with the rotary member to be rotatable integrally therewith;

the rotary core being adapted to receive a strip to be wound thereon when the rotary core is engaged with the rotary member, a spacing being provided between the pin member and a surface of the rotary core whereby a leading end of the strip can be inserted in the space so that the rotary member can be rotated thereby to wind the strip onto the rotary core over the pin member, the rotary core being slidable away from the rotary member so that the pin member is extracted from the roll of strip wound on the rotary core, the roll of strip wound on the rotary core being removable therefrom when the rotary core is at least partly disengaged from the rotary member when winding tension of the wound strip is relaxed by extraction of the pin member from the wound strip.

11. The strip winding mechanism of claim 10, further comprising a stop mechanism for limiting slidable movement of said rotary core on said rotary shaft.

12. The strip winding mechanism of claim 11, wherein said stop mechanism comprises a spacer at an end of said rotary shaft farthest from said rotary member for engaging a stop surface of said rotary core.

13. The strip winding mechanism of claim 11, wherein the stop mechanism comprises a radially extending tab on said rotary member received in an oblong slot in said rotary core, the oblong slot extending in a direction parallel to an axis of said rotary core, the oblong slot having an end acting as a stop surface for engaging said radially extending tab.

14. The strip winding mechanism of claim 10, further comprising a second projecting pin member extending from said rotary member parallel to said rotary shaft and disposed in a relationship of 180° with respect to said first pin member.

15. The strip winding mechanism of claim 14, wherein a distance from a radially outermost surface of the first pin member to a radially outermost surface of the second opposite pin member is greater than the diameter of said rotary core, said pin members being disposed at said spacing away from flat spots provided on said surface of the radial core.

16. The strip winding mechanism of claim 10, wherein said rotary core has a flange for supporting the wound strip on the rotary core and said pin member is slidably received in a hole of a flange of said rotary core.

17. The strip winding mechanism of claim 16, wherein the rotary core is only partly disengageable from the rotary member, whereby the projecting member remains in said hole in the flange of the rotary core even when said rotary core has been stopped from further slidable movement on the rotary shaft by a stop mechanism.

18. The strip winding mechanism of claim 10, further comprising a handle at an end of said rotary core farthest from said rotary member for allowing grasping of said rotary core to disengage it from the rotary member.

* * * * *